US008680828B2

(12) United States Patent
Heng

(10) Patent No.: US 8,680,828 B2
(45) Date of Patent: Mar. 25, 2014

(54) VOLTAGE REGULATOR

(75) Inventor: Socheat Heng, Chiba (JP)

(73) Assignee: Seiko Instruments Inc., Chiba (JP)

( * ) Notice: Subject to any disclaimer, the term of this patent is extended or adjusted under 35 U.S.C. 154(b) by 112 days.

(21) Appl. No.: 13/425,940

(22) Filed: Mar. 21, 2012

(65) Prior Publication Data

US 2012/0242312 A1 Sep. 27, 2012

(30) Foreign Application Priority Data

Mar. 25, 2011 (JP) ..... 2011-068039

(51) Int. Cl.
*G05F 1/565* (2006.01)
*G05F 1/573* (2006.01)

(52) U.S. Cl.
USPC ..... 323/275; 323/277

(58) Field of Classification Search
USPC ..... 323/311–317, 275, 277
See application file for complete search history.

(56) References Cited

U.S. PATENT DOCUMENTS 6,201,375 B1 * 3/2001 Larson et al. ..... 323/277
6,246,555 B1 * 6/2001 Tham ..... 361/18
6,807,040 B2 * 10/2004 Ivanov et al. ..... 361/93.9
7,233,462 B2 * 6/2007 Kanakubo ..... 361/18
7,411,376 B2 * 8/2008 Zhang ..... 323/277
7,646,574 B2 * 1/2010 Imura ..... 361/93.1
7,920,026 B2 * 4/2011 Hughes ..... 330/255
8,004,257 B2 * 8/2011 Imura et al. ..... 323/277
8,174,251 B2 * 5/2012 Kimura ..... 323/273
2009/0285003 A1 * 11/2009 Ishii ..... 363/127

FOREIGN PATENT DOCUMENTS

JP 2001-034351 A 2/2001

* cited by examiner

*Primary Examiner* — Jue Zhang
*Assistant Examiner* — Henry Lee, III
(74) *Attorney, Agent, or Firm* — Brinks Gilson & Lione

(57) ABSTRACT

There is provided a voltage regulator capable of achieving a fast transient response upon activation without allowing an abnormal consumption current to flow. The voltage regulator of the present invention includes: a booster circuit for detecting output current from an output transistor and outputting a boost signal to a first differential amplifier circuit; a sensing transistor for sensing the output current; a first transistor for making an adjustment to enable the output current to be copied accurately; and a second differential amplifier circuit in which the output terminal is connected to the gate of the first transistor, the inverting input terminal is connected to the drain of the sensing transistor, and the non-inverting input terminal is connected to the output terminal.

4 Claims, 5 Drawing Sheets

VOLTAGE REGULATOR

RELATED APPLICATIONS

This application claims priority under 35 U.S.C. §119 to Japanese Patent Application No. 2011-068039 filed on Mar. 25, 2011, the entire content of which is hereby incorporated by reference.

BACKGROUND OF THE INVENTION

1. Field of the Invention

The present invention relates to a voltage regulator circuit including a booster circuit for applying electric current proportional to a load current to a differential amplifier circuit, and more particularly, to a booster circuit to increase the internal power dissipation according to the load current to obtain a fast transient response in order to improve the transient response characteristics of the voltage regulator.

2. Description of the Related Art

A conventional voltage regulator will be described. FIG. 5 is a circuit diagram of the conventional voltage regulator.

The conventional voltage regulator is made up of a differential amplifier circuit 612 for outputting a voltage proportional to a voltage difference from a reference voltage, an output transistor 610 controlled by the output voltage from this differential amplifier circuit 612 to output a voltage produced by a load current corresponding to this output voltage and feed back this output voltage to the differential amplifier circuit 612, and a booster circuit 613 for performing control based on the load current on this output transistor circuit 610 to apply electric current proportional to this load current to the differential amplifier circuit 612 in an area where the load current is low or apply an electric current limited to a constant value to the differential amplifier circuit 612 in an area where the load current is high. The differential amplifier circuit 612 is composed of PMOS type transistors 604 and 605, and NMOS type transistors 601, 602, and 614 to compare a reference voltage 600 with an output voltage 611 so as to output, to the output transistor 610 and the booster circuit 613, a voltage proportional to this voltage difference from commonly connected drains of the transistor 604 and the transistor 601. The transistors 604 and 605 are in a current mirror configuration, in which each source is connected to a power-supply voltage 150, each drain is connected to each of the drains of the transistors 601 and 605, respectively, and both gates are connected to each other and connected to the drain of the transistor 605. Further, the drain of the transistor 604 is connected to each of the gates of the output transistor 610 and a transistor 607 in the booster circuit 613, respectively. Each of the drains of the transistors 601 and 614 is connected to each of the drains of the transistors 604 and 605, each source is commonly connected to each of the drains of the transistors 602 and 606, respectively. Further, the gate of the transistor 601 is connected to the reference voltage 600 and the gate of the transistor 614 is connected to the drain of the output transistor 610, respectively. Each of the drains of the transistors 602 and 606 is commonly connected to each of the sources of the transistors 601 and 614, and each source is connected to the ground voltage, respectively. Further, the gate of the transistor 602 is connected to a bias voltage 603 and the gate of the transistor 606 is connected to the gate of a transistor 609 in the booster circuit 613, respectively. The booster circuit 613 is composed of a PMOS type transistor 607, an NMOS type depression transistor 608, an NMOS type transistor 609, and the like to perform control based on load current IL on the output transistor 610 so as to apply a differential amplifier circuit current IS proportional to this load current IL to the differential amplifier circuit 612 in an area where the load current IL is low or a differential amplifier circuit current IS limited to a constant value through a current-limiting transistor 608 (current limiter) to the differential amplifier circuit 612 in an area where the load current IL is high. The source of the transistor 607 is connected to the power-supply voltage 150 and the drain is connected to the source of the transistor 608, respectively, and further, the gate is connected to the drain of the transistor 604 in the differential amplifier circuit 612. The source of the transistor 608 is connected to the drain of the transistor 607 and the drain is connected to the drain of the transistor 609, respectively, and further, the gate is connected to the ground voltage. The transistor 609 forms a current mirror with the transistor 606 in the differential amplifier circuit 612, where the drain and gate are commonly connected to the gate of the transistor 606 and the source is connected to the ground voltage, respectively (for example, see FIG. 1 in Patent Document 1).

[Patent Document 1] Japanese Patent Application Publication No. 2001-34351

SUMMARY OF THE INVENTION

However, in the conventional technique, since the transistor 608 deciding on the limited current shows large variations in threshold voltage and large temperature dependency, there is a problem that it is very difficult to regulate the amount of boost using trimming. Further, when the regulator is activated in an unloaded state, since the gate of an output driver in an unregulated state sticks to the power supply voltage to operate the booster circuit, there is a problem that consumption current is abnormally increased despite no load.

The present invention has been made in view of the above problems, and it is an object thereof to provide a voltage regulator capable of achieving a fast transient response upon activation without allowing an abnormal consumption current to flow.

A voltage regulator including a booster circuit of the present invention includes: a reference voltage circuit for outputting a reference voltage; an output transistor; a first differential amplifier circuit for amplifying and outputting a difference between the reference voltage and a divided voltage obtained by dividing voltage output from the output transistor to control the gate of the output transistor; a booster circuit for detecting output current from the output transistor and outputting a signal to the first differential amplifier circuit, a sensing transistor for sensing the output current, and a second differential amplifier circuit in which the output terminal is connected to the gate of the first transistor, the inverting input terminal is connected to the drain of the sensing transistor, and the non-inverting input terminal is connected to the output terminal.

The voltage regulator including the booster circuit of the present invention can achieve a fast transient response upon activation without allowing an abnormal consumption current to flow.

DETAILED DESCRIPTION OF THE PREFERRED EMBODIMENTS

Modes for carrying out the present invention will now be described with reference to the accompanying drawings.

First Embodiment

Figure 1:
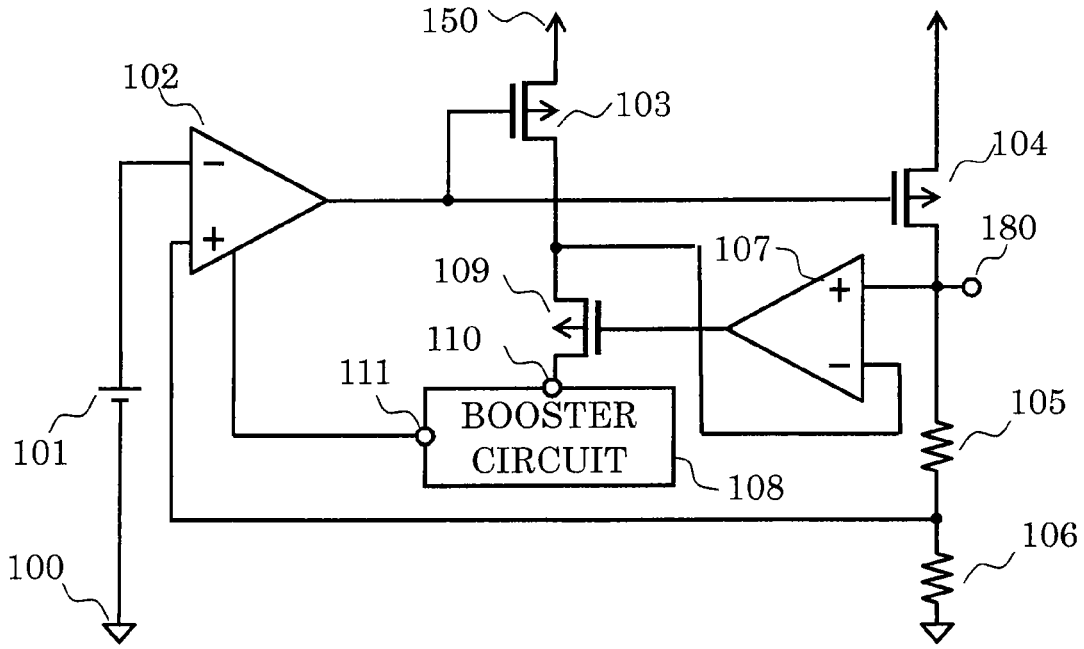
FIG. 1 is a circuit diagram showing a voltage regulator of a first embodiment.

FIG. 1 is a circuit diagram of a voltage regulator of a first embodiment.

The voltage regulator of the embodiment is made up of a reference voltage circuit 101, a differential amplifier circuit 102, PMOS transistors 103, 104, and 109, an amplifier 107, a booster circuit 108, resistors 105 and 106, a ground terminal 100, an output terminal 180, and a power-supply terminal 150. The booster circuit 108 is composed of terminals 110 and 111.

Next, connections in the voltage regulator of the first embodiment will be described.

The inverting input terminal of the differential amplifier circuit 102 is connected to the reference voltage circuit 101, the non-inverting input terminal is connected to a connection point between the resistors 105 and 106, and the output terminal is connected to the gate of the PMOS transistor 104 and the gate of the PMOS transistor 103. The other terminal of the reference voltage circuit 101 is connected to the ground terminal 100. The source of the PMOS transistor 103 is connected to the power-supply terminal 150 and the drain is connected to the source of the PMOS transistor 109 and the inverting input terminal of the amplifier 107. The source of the PMOS transistor 104 is connected to the power-supply terminal 150, and the drain is connected to the output terminal 180, the other terminal of the resistor 105, and the non-inverting input terminal of the amplifier 107. The other terminal of the resistor 106 is connected to the ground terminal 100. The gate of the PMOS transistor 109 is connected to the output terminal of the amplifier 107 and the drain is connected to the terminal 110 of the booster circuit 108. The terminal 111 of the booster circuit 108 is connected to the differential amplifier circuit 102.

Next, the operation of the voltage regulator of the first embodiment will be described.

The resistors 105 and 106 divide output voltage Vout as a voltage at the output terminal 180 to output divided voltage Vfb. The differential amplifier circuit 102 compares output voltage Vref from the reference voltage circuit 101 with divided voltage Vfb to control the gate voltage of the PMOS transistor 104 so as to keep the output voltage Vout constant. When the output voltage Vout is higher than a targeted value, the divided voltage Vfb becomes higher than the reference voltage Vref to raise the output signal of the differential amplifier circuit 102 (the gate voltage of the PMOS transistor 104). Then, the PMOS transistor 104 is turned off to lower the output voltage Vout. Thus, the output voltage Vout is controlled to be constant. When the output voltage Vout is lower than the targeted value, the reverse action is performed to raise the output voltage Vout. Thus, the output voltage Vout is controlled to be constant.

When the power-supply voltage is activated, since the output voltage Vout is low, the differential amplifier circuit 102 performs control to ground the gate voltage of the PMOS transistor 104. As a result, the PMOS transistor 104 is fully turned on and the PMOS transistor 103 is also fully turned on at the same time. Then, the amplifier 107 regulates the gate of the PMOS transistor 109 to make the drain voltages of the PMOS transistors 103 and 104 become equal in order to perform control to enable the PMOS transistor 103 to make an accurate copy of electric current flowing through the PMOS transistor 104. After the output voltage Vout rises, the drain voltage of the PMOS transistor 103 always follows the drain voltage of the PMOS transistor 104 under the control of the amplifier 107 to make an accurate copy of the load current.

The booster circuit 108 detects, at the terminal 110, electric current flowing through the PMOS transistor 103, and outputs a signal according to the current value from the terminal 111 to the differential amplifier circuit 102. After activation of the power-supply voltage, the PMOS transistor 103 outputs a signal to the differential amplifier circuit 102 according to the load current flowing through the PMOS transistor 104 to perform control to increase bias current flowing through the differential amplifier circuit 102. Since this makes the response of the differential amplifier circuit 102 fast, the fluctuation range of output voltage Vout can be made as small as possible. When the load current does not flow, electric current flowing into the PMOS transistor 103 is interrupted and hence no current flows into the booster circuit 108, suspending the operation. Thus, electric current into the booster circuit is interrupted at the time of no load to enable low power consumption. In addition to the load fluctuation, the booster circuit can also work on the power fluctuation when the load current flows and the characteristics of ripple rejection rate to achieve a fast response.

Thus, the voltage regulator of the first embodiment can achieve a fast transient response upon activation of the power-supply voltage or at the time of a load fluctuation or a power fluctuation.

Second Embodiment

Figure 2:
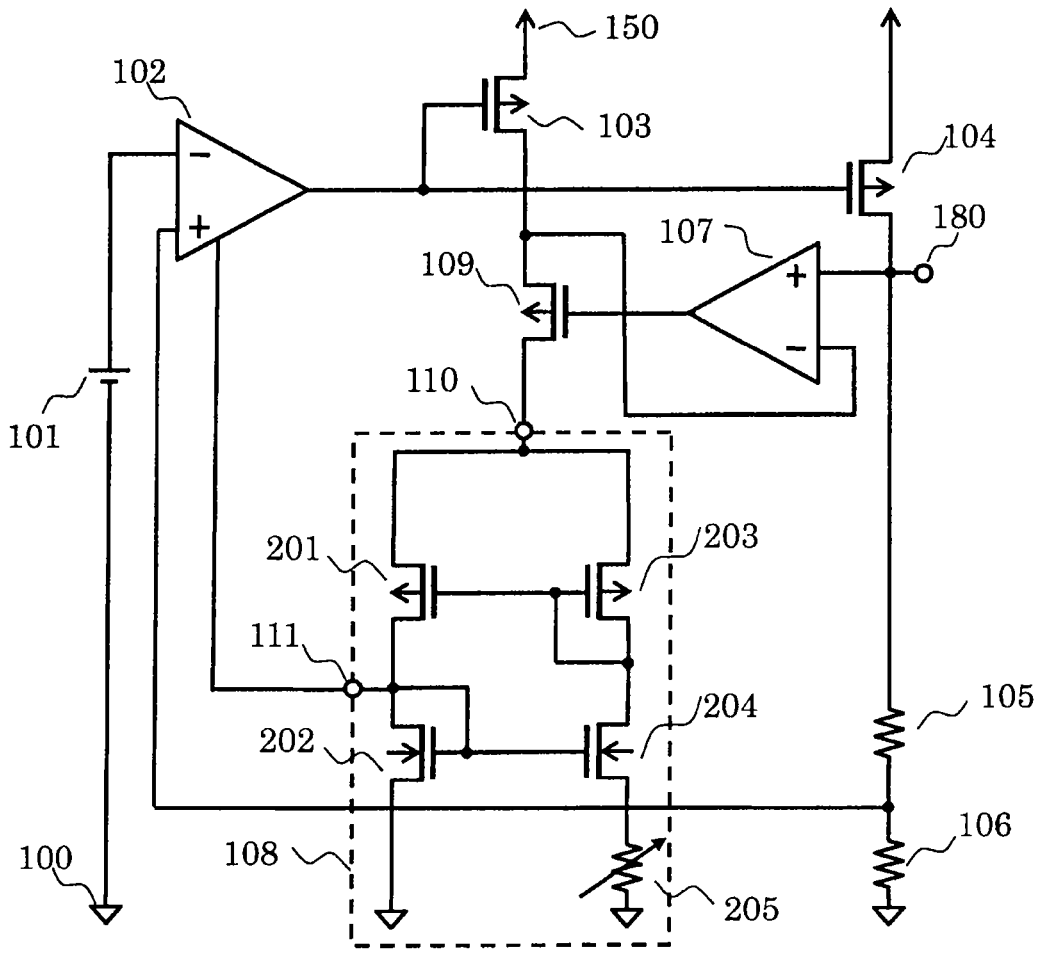
FIG. 2 is a circuit diagram showing a voltage regulator of a second embodiment.

FIG. 2 is a circuit diagram of a voltage regulator of a second embodiment. A point different from FIG. 1 is that the configuration of the booster circuit 108 is specifically shown.

Connections will be described. The source of a PMOS transistor 201 is connected to the terminal 110, the drain is connected to the terminal 111, the drain and gate of an NMOS transistor 202, and the gate of an NMOS transistor 204, and the gate is connected to the gate and drain of a PMOS transistor 203. The source of the MOS transistor 203 is connected to the terminal 110, and the drain is connected to the drain of the NMOS transistor 204. The source of the NMOS transistor 202 is connected to the ground terminal 100, and the source of the NMOS transistor 204 is connected to a resistor 205. The other terminal of the resistor 205 is connected to the ground terminal 100.

Next, the operation of the voltage regulator of the second embodiment will be described. When the power-supply voltage is activated and electric current flows into the PMOS transistor 103, electric current flows from the terminal 110 into the booster circuit 108. The PMOS transistors 201 and 203 form a current mirror circuit. The NMOS transistors 202 and 204 form a current mirror circuit in which both gates are connected to each other, but the source of the NMOS transistor 204 is connected to the ground terminal 100 through the resistor. Therefore, a drop of voltage occurs in the resistor 205 due to the drain current of the NMOS transistor 204, and the gate-source voltage of the NMOS transistor 204 is lowered by the amount. Since the drop of voltage in the resistor 205 is decided by a difference in K value between the NMOS transistors 202 and 204, or a difference in K value between the PMOS transistors 201 and 203 and the value of the resistor 205, it operates as a constant current source circuit independent of the power-supply voltage. Further, if a combination of a poly resistor having negative temperature characteristics and a WELL resistor having positive temperature characteristics is used, the resistor 205 can be obtained as a constant current source circuit independent of temperature.

Using this constant current circuit in the booster circuit, a signal can be output from the terminal 111 to the differential amplifier circuit 102 when the load current flows to increase bias current flowing through the differential amplifier circuit 102. Then, since the response speed of the differential amplifier circuit 102 becomes faster, the fluctuation range of output voltage Vout can be made as small as possible. Further, it can be operated independently of the power-supply voltage or the temperature. In addition to the load fluctuation, the booster circuit can also work on the power fluctuation when the load current flows and the characteristics of ripple rejection rate to achieve a fast response.

Thus, the voltage regulator of the second embodiment can achieve a fast transient response upon activation of the power-supply voltage or at the time of a load fluctuation or a power fluctuation. Further, a fast transient response can be achieved without any influence on the power-supply voltage or temperature.

Third Embodiment

Figure 3:
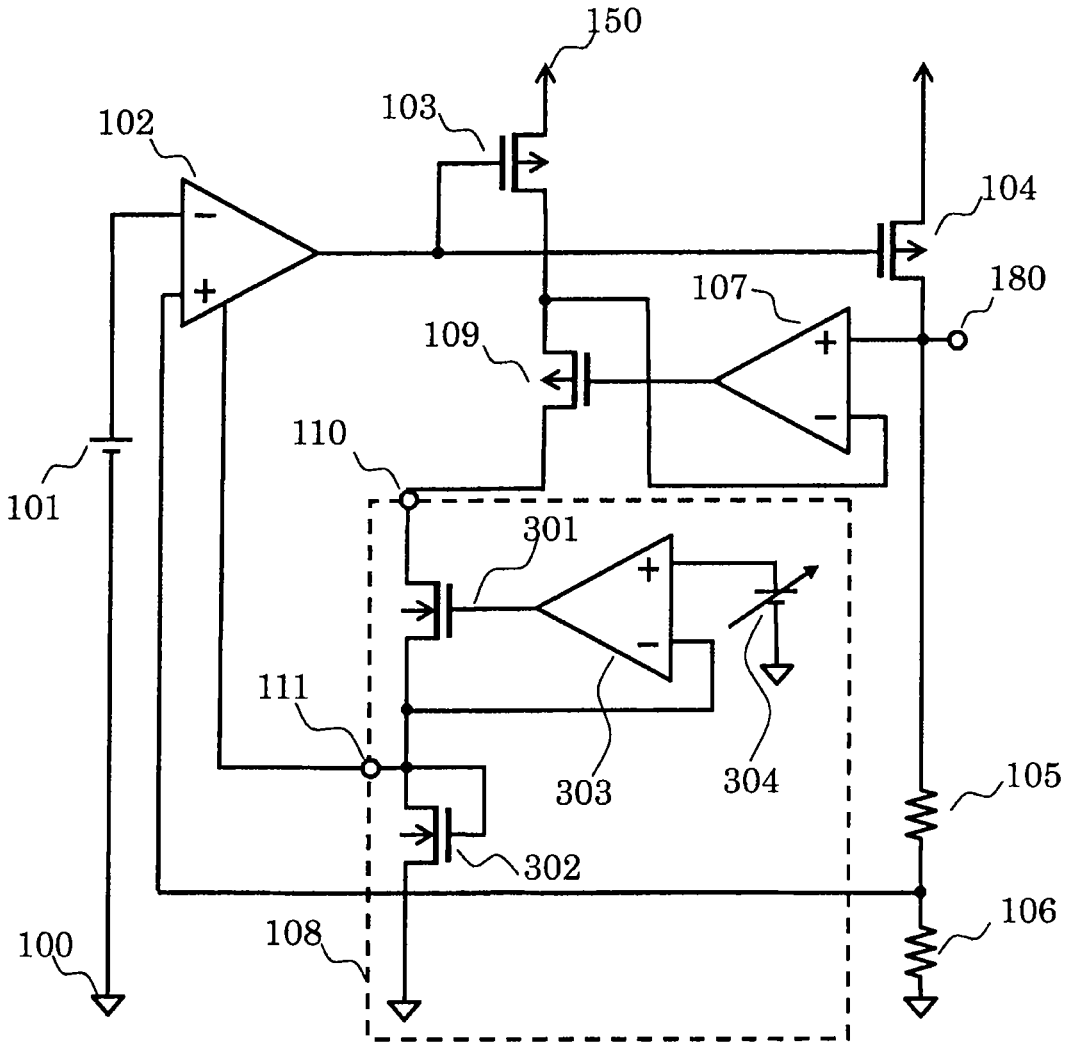
FIG. 3 is a circuit diagram showing a voltage regulator of a third embodiment.

FIG. 3 is a circuit diagram of a voltage regulator of a third embodiment. A point different from FIG. 1 is that the configuration of the booster circuit 108 is specifically shown.

Connections will be described. The drain of an NMOS type transistor 301 is connected to the terminal 110, the gate is connected to the output terminal of an amplifier 303, and the source is connected to the inverting input terminal of the amplifier 303, the gate and drain of an NMOS transistor 302, and the terminal 111. The non-inverting input terminal of the amplifier 303 is connected to a reference voltage circuit 304. The other terminal of the reference voltage 304 and the source of the NMOS transistor 302 are connected to the ground 100.

Next, the operation of the voltage regulator of the third embodiment will be described. When the power-supply voltage is activated and electric current flows into the PMOS transistor 103, electric current flows from the terminal 110 into the booster circuit 108. The booster circuit 108 is made up of a voltage-to-current converter circuit capable of generating a constant current source to output only an amount of boost as a set value. In other words, electric current in the transistor 103 or 109 increases in response to the load current, and when exceeding the set value, it is saturated and becomes constant. Electric current proportional to the electric current at this time is the boost current.

As the load current increases, the electric current in the transistor 103 flows into the transistor 302 via the transistors 109 and 301. However, since the transistor 109 is sufficiently turned on after activation, the amount of electric current flowing into the transistor 302 depends almost on the transistor 301. Therefore, in order to put restrictions on the transistor 301, the amplifier 301 compares a reference voltage 304 with the drain voltage of the transistor 302 to perform control to regulate the amount of electric current in the transistor 301 so as to equalize both voltages. In other words, the reference voltage circuit 304 is so regulated that a signal according to the load current can be generated and output from the terminal 111. In addition to the load fluctuation, the booster circuit can also work on the power fluctuation when the load current flows and the characteristics of ripple rejection rate to achieve a fast response.

Thus, the voltage regulator of the third embodiment can achieve a fast transient response upon activation of the power-supply voltage or at the time of a load fluctuation or a power fluctuation. Further, the reference voltage circuit 304 is so regulated that a signal according to the load current can be output.

Fourth Embodiment

Figure 4:
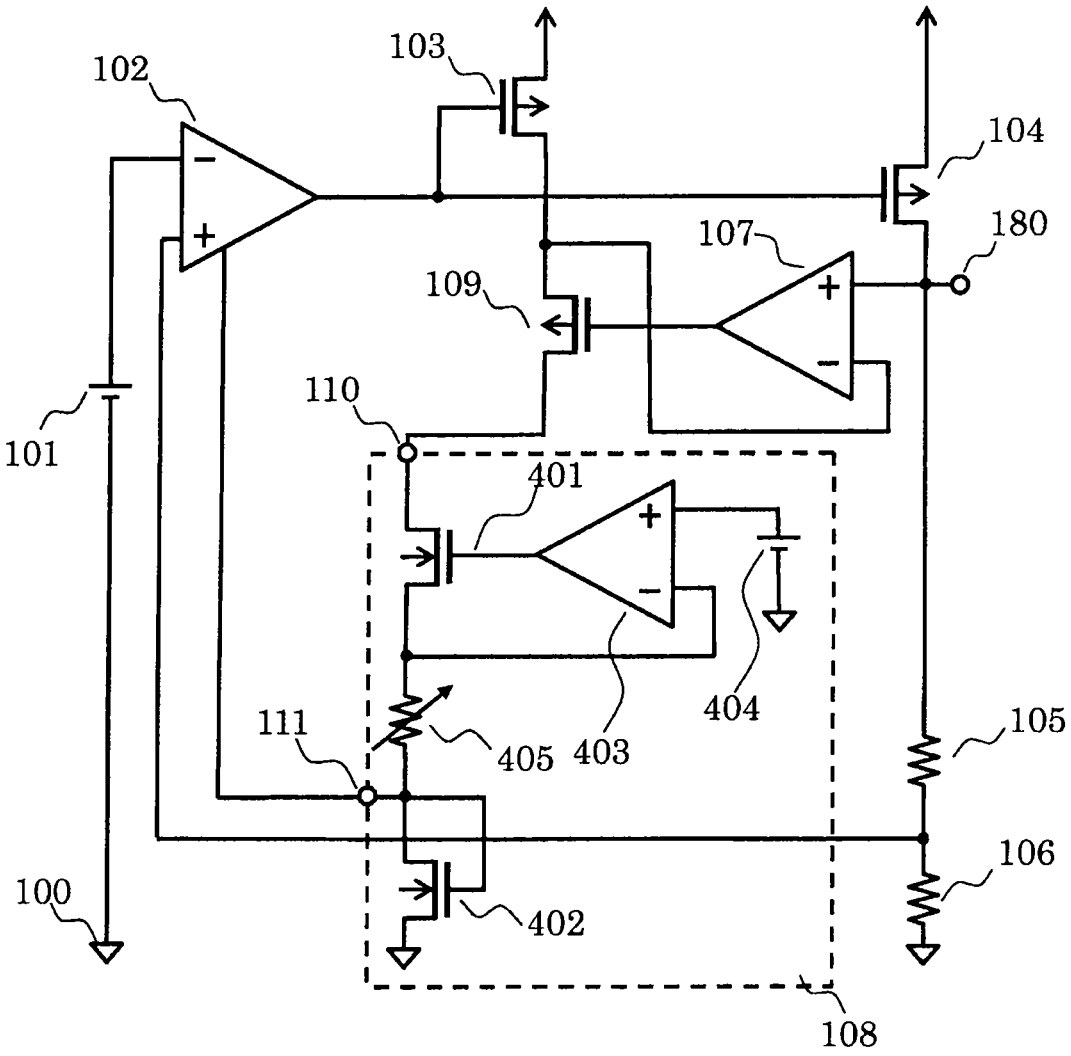
FIG. 4 is a circuit diagram showing a voltage regulator of a fourth embodiment.
Figure 5:
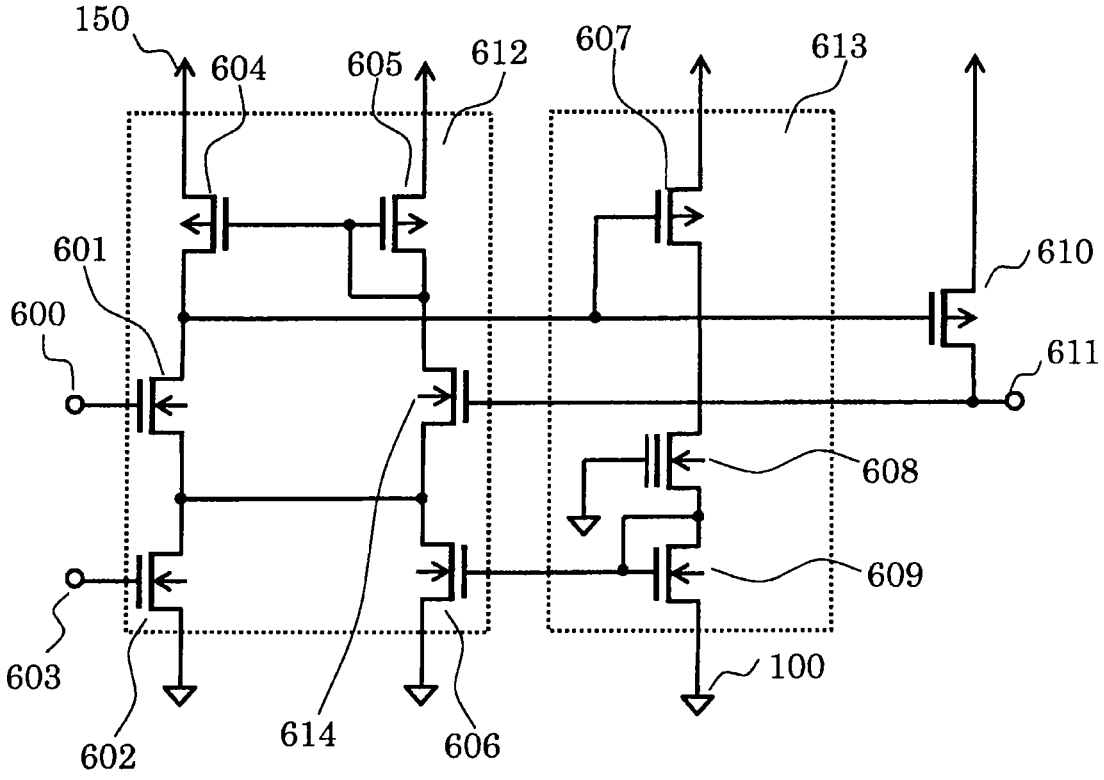
FIG. 5 PRIOR ART
FIG. 5 is a circuit diagram showing a conventional voltage regulator.

FIG. 4 is a circuit diagram of a voltage regulator of a fourth embodiment. A point different from FIG. 3 is that a resistor 405 is added.

Connections will be described. One terminal of a resistor 405 is connected to the inverting input terminal of an amplifier 403 and the other terminal is connected to the terminal 111.

Next, the operation of the voltage regulator of the fourth embodiment will be described. When the power-supply voltage is activated and electric current flows into the PMOS transistor 103, electric current flows from the terminal 110 into the booster circuit 108. The booster circuit 108 is made up of a voltage-to-current converter circuit capable of generating a constant current source to output only an amount of boost as a set value. In other words, electric current in the PMOS transistor 103 or 109 increases in response to the load current, and when exceeding the set value, it is saturated and becomes constant. Electric current proportional to the electric current at this time is the boost current.

The operation of the voltage-to-current converter circuit is as follows: First, as the load current increases, the electric current in the PMOS transistor 103 flows into the NMOS transistor 402 via the PMOS transistor 109 and an NMOS transistor 401. Since the PMOS transistor 109 is sufficiently turned on after activation, the amount of electric current flowing into the transistor 402 depends almost on the transistor NMOS transistor 401. Therefore, in order to put restrictions on the NMOS transistor 401, the amplifier 403 compares a reference voltage 404 with voltage obtained by adding up the drain voltage of the transistor 402 and the voltage on the resistor 405 to perform control to regulate the amount of electric current in the NMOS transistor 401 so as to equalize both voltages. Thus, the resistor 405 is so regulated that a signal according to the load current can be generated and output from the terminal 111. If a combination of a poly resistor having negative temperature characteristics and a WELL resistor having positive temperature characteristics are used, the resistor 405 can be obtained as a constant current source circuit independent of temperature. In addition to the load fluctuation, the booster circuit can also work on the power fluctuation when the load current flows and the characteristics of ripple rejection rate to achieve a fast response.

Thus, the voltage regulator of the fourth embodiment can achieve a fast transient response upon activation of the power-supply voltage or at the time of a load fluctuation or a power fluctuation. Further, the resistor 405 is so regulated that a signal according to the load current can be output.

What is claimed is:

1. A voltage regulator comprising:

a reference voltage circuit for outputting a reference voltage;

an output transistor;

a first differential amplifier circuit for amplifying and outputting a difference between the reference voltage and a divided voltage obtained by dividing voltage output from the output transistor to control a gate of the output transistor;

a booster circuit for detecting output current from the output transistor and outputting a signal to the first differential amplifier circuit, wherein the booster circuit performs control operations to increase a bias current flowing through the first differential amplifier circuit according to an output current from the output transistor, and increases a response time of the first differential amplifier circuit;

a sensing transistor having a gate connected to an output of the first differential amplifier for sensing the output current;

a first transistor having a source connected to a drain of the sensing transistor and to the booster circuit for making an adjustment to enable the output current to be copied accurately by the sensing transistor; and a second differential amplifier circuit in which an output terminal is connected to a gate of the first transistor, an inverting input terminal is connected to the drain of the sensing transistor, and a non-inverting input terminal is connected to an output terminal of the voltage regulator.

2. The voltage regulator according to claim 1, wherein the booster circuit includes:

a second transistor in which a gate is connected to a drain and a gate of a third transistor, a drain is connected to a gate and a drain of a fourth transistor, and a source is connected to a first resistor;

a fifth transistor in which a drain is connected to the drain of the third transistor, and a gate and a source are connected to the gate and source of the fourth transistor, respectively;

the fourth transistor whose gate and drain are connected to the drain of the second transistor;

the third transistor whose source is connected to a ground; and the first resistor connected to the source of the second transistor, whereby a resistance value of the first resistor is adjusted to adjust a value of a load current to be detected.

3. The voltage regulator according to claim 1, wherein the booster circuit includes:

a second transistor whose gate is connected to an output of a third differential amplifier circuit;

a third transistor in which a gate and a drain are connected to a source of the second transistor and an inverting input terminal of the third differential amplifier circuit, and a source is connected to a ground; and the third differential amplifier circuit whose non-inverting input terminal is connected to a second reference voltage circuit, whereby a voltage value of the second reference voltage circuit is adjusted to adjust a value of a load current to be detected.

4. The voltage regulator according to claim 1, wherein the booster circuit includes:

a second transistor whose gate is connected to an output of a third differential amplifier circuit;

a third transistor whose gate and drain are connected to a first terminal of a first resistor; and the third differential amplifier circuit in which a non-inverting input terminal is connected to a second reference voltage circuit, and an inverting input terminal is connected a source of the second transistor and a second terminal of the first resistor, whereby a resistance value of the first resistor is adjusted to adjust a value of a load current to be detected.

* * * * *